US007765978B2

(12) United States Patent
Ruesch et al.

(10) Patent No.: US 7,765,978 B2
(45) Date of Patent: Aug. 3, 2010

(54) DIFFERENTIAL PRESSURE SENSOR FOR FUEL DELIVERY SYSTEMS

(75) Inventors: James R. Ruesch, Lindenhurst, IL (US); Bryan P. Haynes, Libertyville, IL (US)

(73) Assignee: Liquid Controls Corporation, Lake Bluff, IL (US)

( * ) Notice: Subject to any disclaimer, the term of this patent is extended or adjusted under 35 U.S.C. 154(b) by 921 days.

(21) Appl. No.: 11/212,192

(22) Filed: Aug. 26, 2005

(65) Prior Publication Data

US 2007/0044865 A1 Mar. 1, 2007

(51) Int. Cl.
*F02D 17/00* (2006.01)

(52) U.S. Cl. ..... 123/198 D; 318/561; 318/297; 318/580

(58) Field of Classification Search ..... 123/676, 123/349, 478, 480, 153, 169 TC, 352, 361, 123/527, 198 D; 73/114.33; 700/40, 44, 700/71; 318/561, 297, 580; 701/35, 102, 701/104, 110, 29; 290/40 F, 40 E
See application file for complete search history.

(56) References Cited

U.S. PATENT DOCUMENTS

RE28,109 E * 8/1974 Provenzano ..... 701/35
4,330,828 A * 5/1982 Smith et al. ..... 701/102
4,452,207 A * 6/1984 Moore, Jr. ..... 123/676
6,317,680 B1 * 11/2001 Luttrell et al. ..... 701/104
7,359,777 B2 * 4/2008 Betters et al. ..... 701/35

OTHER PUBLICATIONS

Jim Gammon, "Monitoring Differential Pressure During Refueling," www.groundsupportmagazine.com, pp. 40-442.

Beta Systems HT750MRC Hydrant Truck, www.betasystemsinc.com/ht750mre.htm, May 11, 2005 (3 pages).

* cited by examiner

*Primary Examiner*—Stephen K Cronin
*Assistant Examiner*—Keith Coleman
(74) *Attorney, Agent, or Firm*—Miller Matthias & Hull

(57) ABSTRACT

A differential pressure sensor apparatus for use in a fuel delivery system measures the differential pressure of the fuel between a point immediately upstream and a point immediately downstream of a fuel monitor element. The differential pressure sensor apparatus uses an electronic transducer to monitor differential pressure and may be used with interlocks to shutdown fuel delivery if the measured value of the differential pressure is above a predetermined threshold value and to notify an operator of the fuel delivery system of such an increase in the differential pressure.

20 Claims, 3 Drawing Sheets

DIFFERENTIAL PRESSURE SENSOR FOR FUEL DELIVERY SYSTEMS

TECHNICAL FIELD

This patent relates generally to fuel delivery systems and more specifically to control systems used for fuel delivery systems.

BACKGROUND

Liquid products are commonly delivered to customers via delivery truck or other similar mechanism. The amount of liquid product is often measured by a liquid flow meter as the product is being pumped from a supply tank or truck to the customer's storage tank. From the time fuel is refined to the time of its final delivery, fuel is filtered at a number of locations. Generally, fuel is filtered every time it is moved to provide the maximum level of safety and guarantee that no impurities, such as water are delivered with the fuel.

Especially, the aviation industry is characterized by extremely stringent controls on fuel quality. Dirty or water-contaminated fuel is not an option. From the time jet fuel is refined, it is usually filtered every time it is moved to provide the maximum level of safety. In recognition of the extreme criticality of clean fuel, expensive fuel quality measures are built into fuel handling systems, from the point of fuel storage to fuel delivery into an airplane. Such measures include quality checks at fuel storage facilities, in fuel pipelines, white bucket tests at fueling sites, use of filters and/or separators (hereinafter referred to simply as "filters") in fuel delivery vehicles to catch contaminated fuel right up to the moment of delivery, etc.

While filter manufacturers make their products as safe as possible using exhaustive tests, they do not provide one hundred percent protection against any malfunctioning of the filters. Therefore, it is necessary to monitor the performance of such filters when used on fuel delivery vehicles. Moreover, fuel filters used by fuel delivery vehicles often get compromised due to overuse. For example, filters often get plugged over time and such plugged filters may cause build up of excessive pressure in the fuel delivery systems, therefore allowing passage of contaminated fuel through such filters. Operators of fuel delivery systems are supposed to check the functioning of the fuel filters on a regular basis. However, due to a number of reasons including time and cost constraints, often, such filters are used even when they are not functioning properly. One mechanism that may be used to measure the functioning of the fuel filters is to monitor the differential pressure across the filter using mechanical pressure gauge that is manually checked by the operator while delivering fuel. However, because fuel delivery operators are generally more pre-occupied with performing other aspects of his job, they often do not check the differential pressure using the mechanical gauge.

Therefore, there is a need for a method or an apparatus for automatically monitoring performance of filters used in fuel delivery systems.

SUMMARY

A differential pressure sensor apparatus for use in a fuel delivery system measures the differential pressure of the fuel between a point immediately upstream and a point immediately downstream of a fuel filter element. The differential pressure sensor apparatus uses an electronic transducer to monitor differential pressure and may be used with interlocks to shutdown fuel delivery if the measured value of the differential pressure is above a predetermined threshold value and to notify an operator of the fuel delivery system of such an increase in the differential pressure.

In an embodiment, the differential pressure sensor apparatus generates an alarm signal when the differential pressure is higher than a threshold signal, wherein such an alarm signal may be sent to a controller, which may control flow of fuel in the fuel delivery system via adjusting the operation of a valve. In response to the alarm signal from the differential pressure sensor apparatus, such a controller may shut down the fuel flow through the valve.

In another embodiment, the differential pressure sensor apparatus includes a fuel flow rate measurement apparatus adapted to measure the rate of fuel flow through the fuel delivery system. The fuel flow measurement apparatus measures fuel flow pulses over a pre-determined period of time and stores the measured values of the fuel flow pulses. Using the k-factor of the fuel delivery system and the stored values of the fuel flow pulses, the fuel flow measurement apparatus calculates the fuel flow rate.

In a refinement of this embodiment, the differential pressure sensor apparatus may be communicatively connected to a controller operating a valve controlling the flow of fuel in the fuel delivery system. For example, the differential pressure sensor apparatus may be communicatively connected to the controller operating a valve via an RS-485 communication link. In an alternate embodiment, the differential pressure sensor apparatus may be communicatively connected to the controller in a wireless manner.

In yet another embodiment, the differential pressure sensor apparatus may be communicatively connected to a printer attached to the fuel delivery system where such printer is used to print a receipt for the fuel delivery. The printer may be adapted to print the value of the peak differential pressure recorded during the fuel delivery. The printer may be also adapted to print a message on the receipt for fuel delivery denoting the shutting down of the valve controlling the rate of fuel flow in the fuel delivery system. For example, the printer may be adapted to print a message of "FILTER OVERPRESSURE SHUTDOWN" on a fuel delivery receipt.

In another embodiment, the differential pressure sensor apparatus may send an alarm signal to an operator of the fuel delivery system in response to detecting the differential pressure being higher than a predetermined threshold. For example, the differential pressure sensor apparatus may send the alarm signal to a pager, a cell-phone or other device selected by the operator, to which the alarm signal may be sent to. In such a situation, in response to the alarm signal, the operator may be able to manually shutdown the delivery of fuel in the fuel delivery system.

An improved method of detecting differential pressure at a point in a fuel delivery system is also disclosed. The improved method comprises measuring differential pressure at an intermediate point in the fuel delivery system using an electronic transducer, comparing the differential pressure with a threshold level, and closing a valve controlling flow of fuel at the intermediate point if the differential pressure is higher than the threshold level.

Another refinement of the method of detecting differential pressure at a point in a fuel delivery system also comprises generating an alarm signal to be sent to a controller if the differential pressure is higher than the threshold level. Subsequently and in response to the alarm signal, the controller may completely shut off fuel delivery by closing off a control valve.

BRIEF DESCRIPTION OF THE DRAWINGS

The disclosed embodiments are disclosed more or less diagrammatically in the accompanying drawings, wherein.

It should be understood that the drawings are not necessarily to scale and that the embodiments are sometimes illustrated by graphic symbols, phantom lines and diagrammatic representations. In certain instances, details which are not necessary for an understanding of the disclosed systems and methods or which render other details difficult to perceive may have been omitted. It should be understood, of course, that the concepts disclosed herein are not necessarily limited to the disclosed embodiments.

DETAILED DESCRIPTION OF THE PRESENTLY PREFERRED EMBODIMENTS

Figure 1:
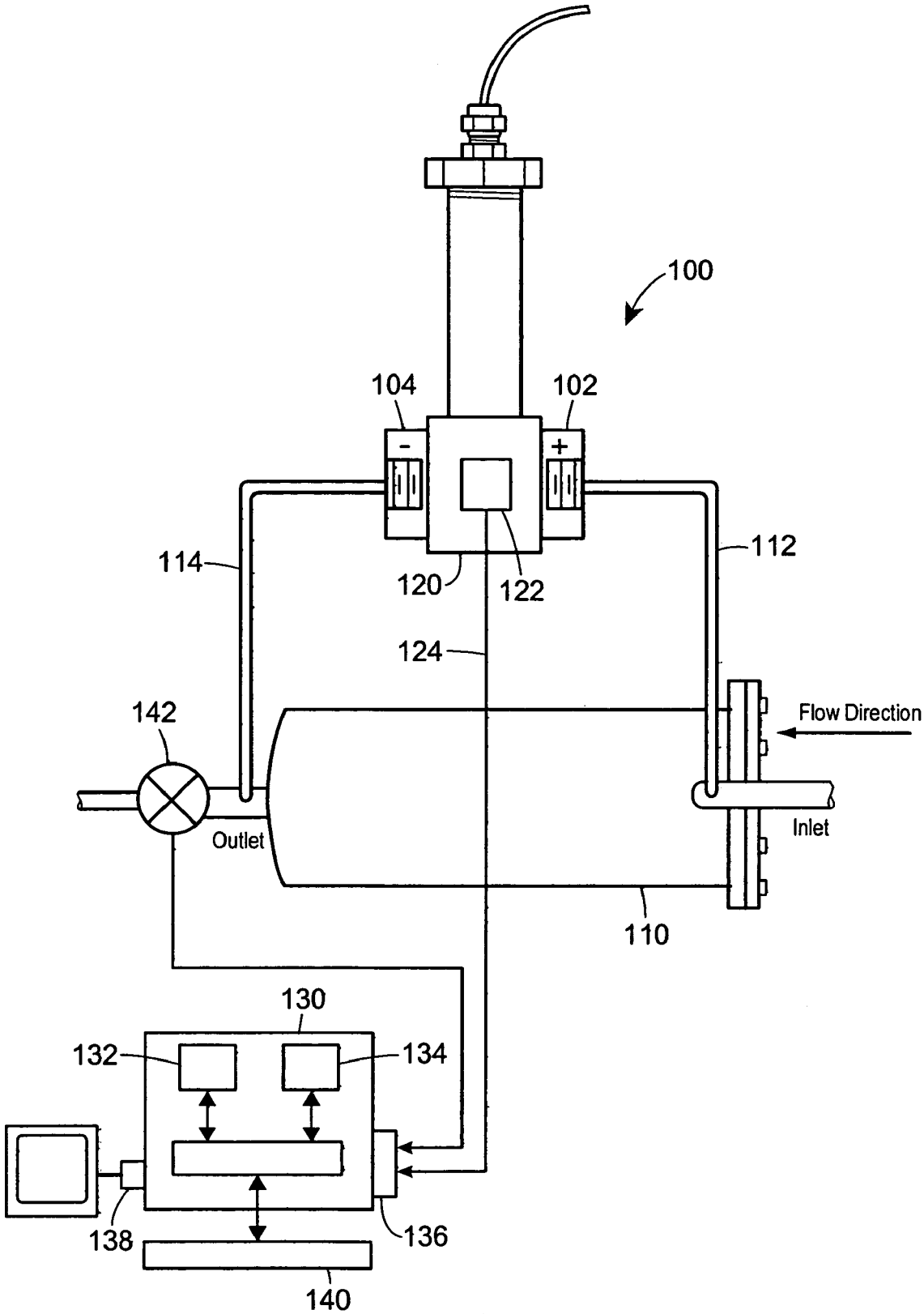
FIG. 1 is a block diagram of a preferred embodiment of the differential pressure sensor apparatus.

Turning to FIG. 1, a differential pressure sensor apparatus 100 that may be used to measure differential pressure at any point in a fuel flow system is illustrated. The differential pressure sensor apparatus 100 includes two ports 102, 104 to connect the differential pressure sensor apparatus 100 to a fuel delivery system. For example, the ports 102, 104 may be female ports complying with a specific national pipe thread (NPT) standard. The differential pressure sensor apparatus 100 is connected, using the ports 102 and 104, to an intermediate point of a fuel delivery system at which the differential pressure measurement is desired. For example, the differential pressure sensor apparatus 100 may be used to measure differential pressure at a flow monitor 110. A flow monitor is a filter which may be used to filter water and other impurities from the fuel being delivered through the fuel delivery system. Alternatively, other types of filters, such as water coalescers may also be used in the place of flow monitor 110.

The differential pressure sensor apparatus 100 is designed in a manner so that one of the ports 102, 104 is always connected to the inlet end of fuel flow and the other port is connected to the outlet end of the fuel flow. For example, the port 102, which is marked by a positive (+) sign, may be always connected to the inlet end of the flow monitor 110 while the port 104, which is marked by a negative (−) sign may be always connected to the outlet end of the flow monitor 110. Note that if the connections of the inlet and outlet ends of the flow monitor 110 are reversed, the differential pressure sensor apparatus 100 may not function at all or it may give negative pressure information. Ports 102, 104 may be connected to both ends of the flow monitor 110 or at any other point on a fuel delivery system using process tubes 112, 114.

The differential pressure sensor apparatus 100 also includes a pressure sensing chamber 120 that may house a differential pressure (DP) transducer 122. The DP transducer 122 may be an electronic DP transducer that measures DP at the flow monitor 110. An example of such a DP transducer 122 is a series 30 pressure transducer provided by Keller™ Instruments. The differential pressure sensor apparatus 100 may be used to measure differential pressure typically in the range of 0 to 60 pounds per square inch differential (PSID).

The DP transducer 122 may be connected via a communication cable 124 to a computer 130. For example, when the DP transducer 120 is a Keller™ series 30 transducer, the communication cable 124 may be an RS-485 cable. The computer 130 may include a processor 132, a memory 134 and an input port 136 that may be used to connect to any input devices, such as a keyboard, the communication cable 124, etc., and an output port 138 that may be used to connect to one or more output devices such as a printer, monitor, etc.

Alternatively, the DP transducer 122 may be connected to the computer 130 in a wireless manner. Allowing such wireless connectivity to the DP transducer 122 alleviates problems related to connecting a cable at an intermediate point in a fuel delivery system. Moreover, when the DP transducer 122 is adapted to communicate to the computer 130, the DP transducer 122 may also connect to other wireless communication devices, such as a pager used by an operator of the fuel delivery system, a cell-phone used by the operator, etc. in a wireless manner.

The computer 130 may also be connected via the input port 136 to a flow meter 142. The flow meter 142 may be used to measure the rate of flow of fuel in the fuel delivery system. Thus, the computer 130 may receive a number of differential pressure observations from the DP transducer 122, the fuel flow rate observations from the flow meter 142, as well as one or more inputs from a user of the differential pressure sensor apparatus 100. In an alternate embodiment, the computer 130 may also be connected via a communication network 140 to a process control network monitoring delivery of fuel.

Figure 2:
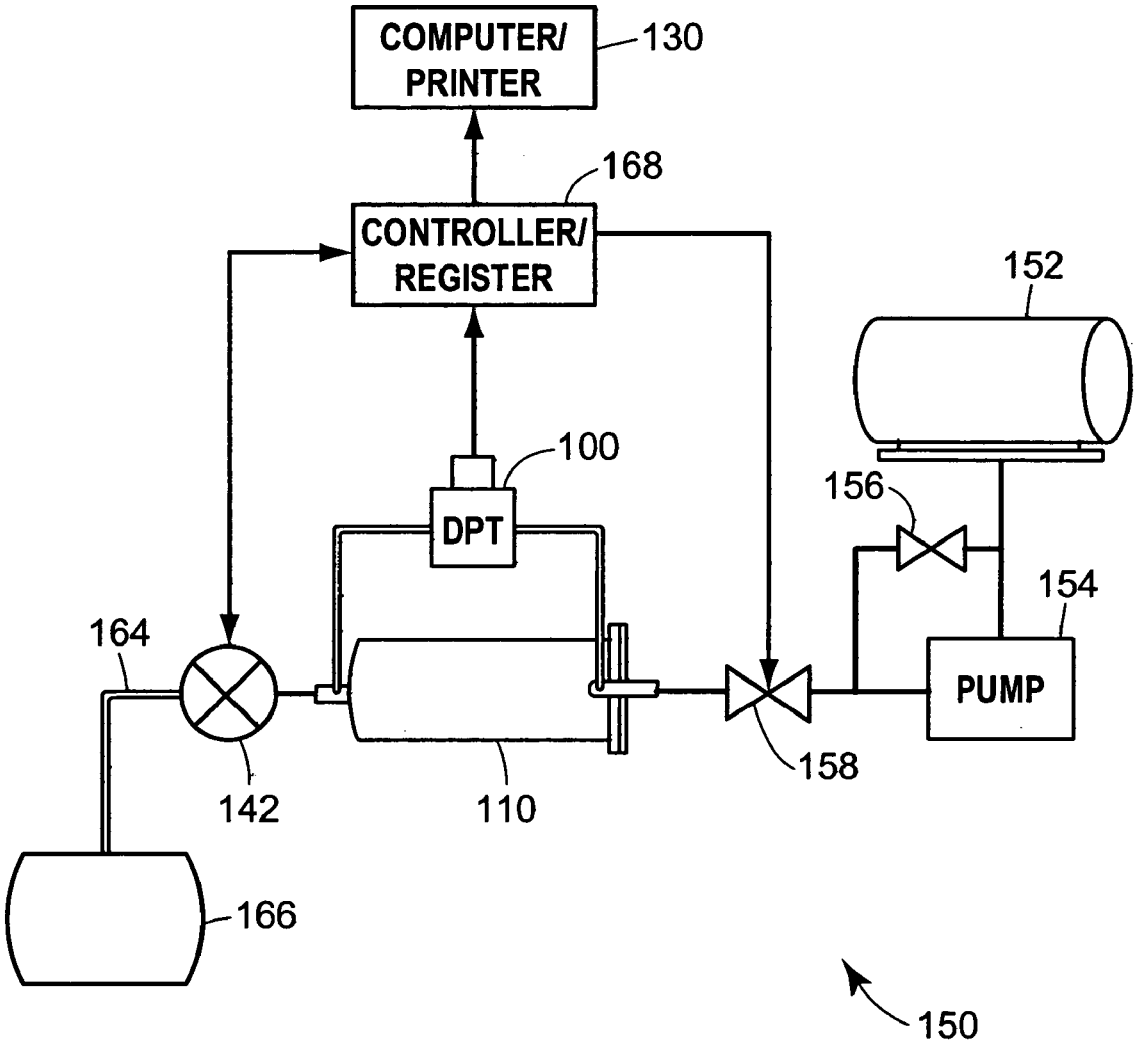
FIG. 2 is a schematic illustration of a fuel delivery system using a differential pressure sensor apparatus.

FIG. 2 illustrates a fuel delivery system 150 that may use the differential pressure sensor apparatus 100 discussed above. The fuel delivery system 150 may be a system delivering fuel from a fuel delivery truck to an aircraft, from a fuel storage tank to a fuel delivery truck, etc. The fuel delivery system 150 includes a fuel supply tank 152, a supply pump 154, a bypass valve 156, a control valve 158, the flow monitor 110, the flow meter 142, a fuel delivery hose 164 and a fuel receiving tank 166. The fuel delivery system 150 supplies fuel from the fuel supply tank 152 to the fuel receiving tank 166 using the pump 154. The flow monitor 110 may be used to filter the fuel flowing into the storage tank 166 and the valve 158 may be used to control the flow of fuel into the storage tank 166.

The flow monitor 110 may be used to filter the fuel flowing into the storage tank 166. For example, the flow monitor 110 may be a water separator used to ensure that no water or air is transferred into the storage tank 166 via the fuel delivery system 150. Over a long usage period, such a water separator may be damaged due to clogging, etc., which may result in building up of pressure through the flow monitor 110. As one of ordinary skill in the art would appreciate, such increase in pressure may result in lower performance level and efficiency, subsequently resulting in higher level of water passing through the flow monitor 110.

The differential pressure sensor apparatus 100 may be installed at such a flow monitor 110 to monitor the differential pressure through the flow monitor 110 so as to determine the operating condition of the flow monitor 110. The differential pressure sensor apparatus 100 may be connected to a controller 168 that may be capable of operating the valve 158. In one implementation of the fuel delivery system 150, the differential pressure sensor apparatus 100 may be connected to the controller 168 via an RS-485 communication cable. Alternatively, the differential pressure sensor apparatus 100 may be connected to the controller 168 in a wireless manner.

In an implementation of the fuel delivery system 150, the controller 168 may be connected to the computer 130 via an RS-232 cable. The differential pressure sensor apparatus 100 may be in constant communication with the controller 168, i.e., the differential pressure sensor apparatus 100 may communicate each measurement of the DP at the flow monitor 110 and the flow rate at the flow meter 142 to the controller 168. Alternatively, the differential pressure sensor apparatus 100 may communicate with the controller 168 only when it detects that the DP at the flow monitor 110 is higher than a pre-determined threshold provided by an operator of the fuel delivery system 150.

Upon receiving a signal from the differential pressure sensor apparatus 100, the controller 168 may analyze such signal to determine if it needs to change the operation of the valve 158 and/or of the fuel pump 154. For example, if the controller 168 receives a signal from the differential pressure sensor apparatus 100 suggesting that the DP at the flow monitor 110 is above the predetermined threshold, the controller 168 may shut down the operation of the valve 158 and it may also shut down the operation of the fuel pump 154. Additionally, the controller 168 may instruct the computer 130 to generate a receipt with a special message indicating the shut down of the valve 158. In yet another implementation, the controller 168 may also generate a message to an operator of the fuel delivery system 150, in a wireless or in some other manner, indicating the shut down of the valve 158. The controller 168 may use a computer program that may be stored on the controller 168 or on the computer 130 to undertake one or more of the above operations.

Figure 3:
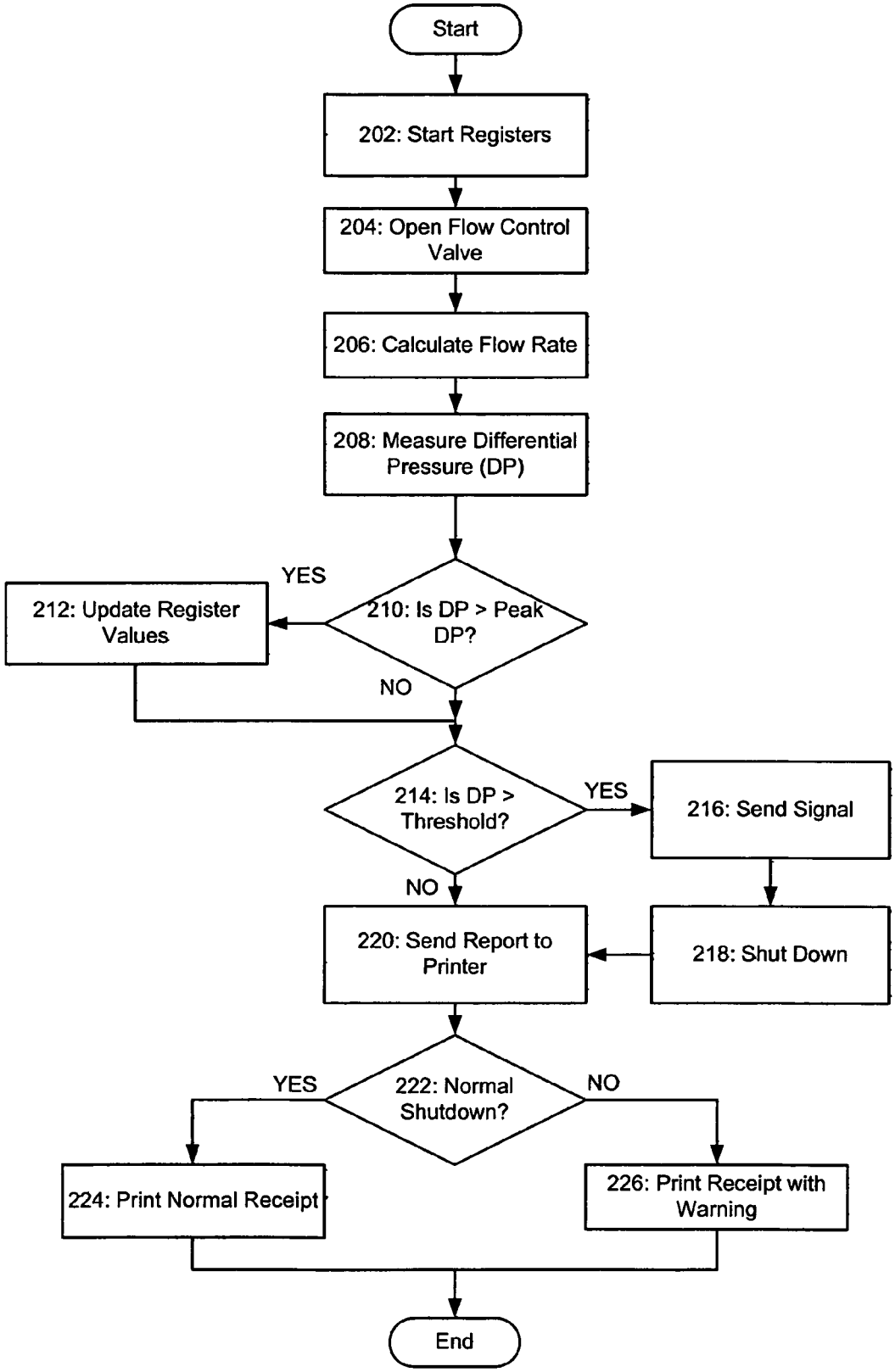
FIG. 3 illustrates a flow chart of a method of using the differential pressure sensor apparatus.

FIG. 3 illustrates a flowchart of a program 200 for using the differential pressure sensor apparatus 100. Note that while the flowchart 200 illustrates various blocks performing a number of actions in a specific order, one of ordinary skill in the art would appreciate that in an alternate embodiment, the order of one or more of such blocks may be altered in any desired manner. Moreover, one or more of the blocks of the program 200 may be implemented using any of software, hardware, firmware or any combination thereof. The program 200 may be stored on the memory 134 or it may be implemented at the controller 168.

A block 202 starts various registers, where such registers may be located within the controller 168 or any other memory that is communicatively connected to the differential pressure sensor apparatus 100. For example, one of the registers initiated by the block 202 may be a fuel delivery counter that is used to totalize the amount of fuel delivered by the fuel delivery system 150. Such a fuel delivery counter may be communicatively connected to a display counter that is used to display the amount of fuel delivered using the fuel delivery system 150. For example, when the fuel delivery counter is initiated, the display counter may display "000000" as the amount of fuel delivered, etc.

The block 202 may also initiate a peak DP register that may be used to store the peak DP during the delivery of fuel through the fuel delivery system 150 and a peak DP flow rate register that may be used to store the flow rate corresponding to the peak DP. The fuel delivery counter, the peak DP register and the peak DP flow rate register may be implemented on the controller 168, in the computer 130 or at any other location which may be communicatively connected to the differential pressure sensor apparatus 100.

After initiating the various registers, a block 204 opens the flow control valve 158 to starts delivering fuel from the fuel supply tank 152 to the fuel receiving tank 166. Fuel may flow from the fuel supply tank 152 to the fuel storage tank 166 through the fuel pump 154, or alternatively, circulate through the bypass valve 156 when control valve 158 is closed.

A block 206 calculates the rate of flow of fuel in the fuel delivery system 150. The block 206 may calculate the rate of flow by measuring flow pulses using the flow meter 142, accumulating the flow pulse measurements in a memory and calculating the flow rate based on the accumulated flow pulses over a period of time. The block 206 may use k-factor (ratio of flow meter input pulses per unit of flow) per unit of time to determine flow rate. For example, the block 206 may calculate flow rate at the flow meter 142 at every half second intervals.

A block 208 measures the differential pressure (DP) at the intermediate point using the differential pressure sensor apparatus 100 described above. After measuring the DP at the block 208, a block 210 compares the measured DP with the DP value stored in the peak DP register. If the block 210 determines that the measured value of DP is higher than the value of DP stored in the peak DP register, a block 212 updates the stored value in the peak DP register with the measured value of the DP and stores the latest measured value of fuel flow rate in the peak DP flow rate register.

Subsequently, a block 214 compares the measured value of DP with a threshold DP value to determine if the measured DP is acceptable or not. As discussed above, if the intermediate point is selected at a control element of the fuel delivery system 150, the DP level may indicate the health or efficiency of such a control element. For example, if the intermediate point was selected to be at a fuel filter, higher DP at such a fuel filter may indicate that the fuel filter may not be functioning properly. This may be due to increased clogging of the filter or some other reason that may cause a rise in the DP at the fuel filter.

The block 214 may receive the threshold DP value from the user of the fuel delivery system 150. If the block 214 determines that the DP at the intermediate point is above such a threshold DP value, a block 216 may generate and send a signal to the controller 168 attached to the valve 158 controlling the supply of fuel through the fuel delivery system 150. In response to such a signal from the block 212, a block 218 may shut down the valve 158. Alternatively, the block 218 may send a signal to the controller 168, which may in turn close the valve 158. In an embodiment of the fuel delivery system 150, the controller 168 may also generate an alarm signal that may notify a user of the fuel delivery system 150 that the DP at the intermediate point is higher than a threshold DP value, signifying a malfunctioning of a fuel filter, a flow monitor, etc.

Subsequently, a block 220 sends a report to the computer 130 regarding the DP at the intermediate point as well as the fuel flow rate at the intermediate point. A block 222 determines if the fuel delivery is completed without any abnormal shutdown or not. If the block 218 determines that the fuel delivery was completed without recordation of the measured DP value being higher than threshold DP value, a block 224 prints a receipt noting the peak DP value as stored in the peak DP register, the peak DP flow rate as per the peak DP flow rate register, and the total amount of fuel delivered. The block 224 may determine the amount of fuel delivered using the flow rate measurements made by the flow meter and/or based on the value stored in the fuel delivery counter.

Alternatively, the block 218 determines that the fuel delivery was shut down in response to a measurement of DP at the intermediate point being higher than the threshold DP value, the computer 130 may print a warning such as "FILTER OVERPRESSURE SHUTDOWN" or any other warning at the bottom of the printer receipt.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of electronically controlling fuel flow across a fuel filter in a fuel delivery system that delivers fuel from a fuel supply to a fuel storage for an aircraft, the method comprising:

measuring differential pressure using an electronic pressure transducer across the fuel filter by electronically detecting pressure at an inlet to the fuel filter and at an outlet to the fuel filter;

comparing the measured differential pressure with a threshold level; and shutting off the flow of fuel to the fuel filter at a control valve upstream of the fuel filter if the differential pressure is higher than the threshold level.

2. A method of claim 1, further comprising generating an alarm signal to be sent to a controller operating the control valve controlling rate of fuel flow, if the measured differential pressure is higher than the threshold level.

3. A method of claim 2, further comprising generating a printed receipt with a message denoting the measured differential pressure being higher than the threshold level.

4. A method of claim 3, wherein measuring differential pressure further comprises measuring differential pressure across the fuel filter of a fuel delivery system used for delivering fuel to an aircraft.

5. A method of claim 4, further comprising interfacing the electronic pressure transducer with a controller using an RS-485 communicator.

6. A method of claim 4, further comprising measuring fuel flow rate with a flow meter disposed at the outlet of the fuel filter.

7. A method of claim 4, further comprising communicating the value of the differential pressure to an operator of the fuel delivery system in a wireless manner.

8. A method of claim 6, wherein measuring the fuel flow rate further comprises:

detecting a number of flow pulses generated by the flow meter;

accumulating the number of flow pulses for a selected time; and converting the accumulated number of flow pulses to the fuel flow rate using a k-factor, a unit of flow and the selected time.

9. A method of claim 6, further comprising:

measuring a peak differential pressure at the fuel filter of the fuel delivery system; and measuring the flow rate at the flow meter corresponding to the peak differential pressure in the fuel delivery system.

10. A method of claim 9, wherein the printed receipt includes a message denoting the peak differential pressure and the corresponding flow rate at the flow meter.

11. An electronic differential pressure sensor apparatus for use across a fuel filter of a fuel delivery system for use with aircrafts, the apparatus comprising:

a processor;

a memory communicatively attached to the processor;

an electronic differential pressure transducer linked to inlet and outlet ends of the fuel filter and communicatively connected to the processor, a control valve disposed upstream of the filter and communicatively connected to the processor;

a flow meter disposed downstream of the filter and communicatively connected to the processor;

wherein the electronic differential pressure transducer is adapted to measure differential pressure across the filter of the fuel delivery system and to store the differential pressure in the memory; and wherein the processor shuts off or restricts flow through the control valve if the differential pressure exceeds a threshold value stored in the memory.

12. A differential pressure sensor apparatus of claim 11, wherein the memory is further adapted to store a first software routine operable on the processor, wherein the first software routine is adapted to:

compare the differential pressure with the threshold value; and generate a shutdown signal if the differential pressure is higher than the threshold value.

13. A differential pressure sensor apparatus of claim 12, wherein the memory is further adapted to store a second software routine operable on the processor, wherein the second software routine is adapted to:

measure values of flow pulses generated by the flow meter for a period;

store the measured values of the flow pulses in the memory; and calculate a rate of fuel flow based on the stored values of the fuel flow.

14. A differential pressure sensor apparatus of claim 13, wherein the differential pressure transducer is further adapted to measure the differential pressure across the filter by measuring an upstream pressure at point immediately upstream of the filter, measuring a downstream pressure at point immediately downstream of the filter and calculating the difference between the upstream pressure and the downstream pressure to determine the differential pressure.

15. A differential pressure sensor apparatus of claim 14, wherein the differential pressure transducer is further adapted to measure the upstream pressure using an electronic transducer and to measure the downstream pressure using an electronic transducer.

16. A differential pressure sensor apparatus of claim 15, wherein the differential pressure sensor apparatus is communicatively connected to the processor via an RS-485 connector.

17. A differential pressure sensor apparatus of claim 15, wherein the differential pressure sensor apparatus is communicatively connected to the processor in a wireless manner.

18. A differential pressure sensor apparatus of claim 15, wherein the processor is communicatively connected to a printer further adapted to print a message on the fuel delivery receipt denoting the shutdown of the control valve in response to the shutdown signal.

19. A differential pressure status apparatus of claim 18, wherein the memory is further adapted to store a third software routine operable on the processor, wherein the third software routine is adapted to:

measure a peak differential pressure across the filter of the fuel delivery system; and measure a flow rate downstream of the filter corresponding to the peak differential pressure at the intermediate point in the fuel delivery system.

20. A differential pressure status apparatus of claim 19, wherein the memory is further adapted to store a fourth software routine operable on the processor, wherein the printer is further adapted to generate a printed receipt with a message denoting the peak differential pressure across the filter and the corresponding flow rate at the flow meter.

* * * * *